United States Patent [19]

Wolle

[11] Patent Number: 4,971,124

[45] Date of Patent: Nov. 20, 1990

[54] SLIVER PATCHING METHOD AND APPARATUS

[76] Inventor: Christopher S. Wolle, 75 NE. Craven Apt. 1, Bend, Oreg. 97702

[21] Appl. No.: 414,905

[22] Filed: Sep. 29, 1989

[51] Int. Cl.[5] ..... B27G 1/00

[52] U.S. Cl. ..... 144/332; 144/2 R; 144/2 M

[58] Field of Search ..... 144/1 R, 2 R, 3 R, 330, 144/332, 2 M

[56] References Cited

U.S. PATENT DOCUMENTS

| | | | |
|---|---|---|---|
| 1,904,109 | 4/1933 | Wendorf . | |
| 2,536,665 | 1/1951 | Skoog | 144/332 |
| 2,915,095 | 12/1959 | Pelto . | |
| 3,003,527 | 10/1961 | Fortune . | |
| 3,111,148 | 11/1963 | Herrman et al. . | |
| 3,770,031 | 11/1973 | Olson . | |
| 3,827,468 | 8/1974 | Markham . | |
| 3,835,902 | 9/1974 | Elmendorf | 144/332 |
| 3,865,161 | 2/1975 | Vizziello et al. . | |
| 3,942,566 | 3/1976 | Schmidt . | |
| 4,080,698 | 3/1978 | Zenses . | |
| 4,127,153 | 11/1978 | Cipollone . | |
| 4,420,358 | 12/1983 | Kindt et al. . | |
| 4,437,501 | 3/1984 | Canada et al. . | |
| 4,471,822 | 9/1984 | Griganavicius . | |
| 4,632,160 | 12/1986 | Wright . | |

FOREIGN PATENT DOCUMENTS

| | | | |
|---|---|---|---|
| 104421 | 4/1984 | European Pat. Off. | 144/332 |
| 2328748 | 9/1975 | Fed. Rep. of Germany . | |
| 2851964 | 1/1979 | Fed. Rep. of Germany . | |
| 146022 | 9/1902 | German Democratic Rep. . | |

*Primary Examiner*—W. Donald Bray

*Attorney, Agent, or Firm*—Klarquist, Sparkman, Campbell, Leigh & Whinston

[57] ABSTRACT

A sliver patching method and apparatus cuts a long slender groove in a small dimension high-grade wood product to remove long slender defects lying along the grain of the wood product. A wood sliver corresponding at least partially in size and shape to said groove is inserted in the groove and secured by adhesive. Because the sliver is narrow and follows the grain of the wood product, the patch is hidden within the natural wood grain pattern and the wood product may be used for high quality finish applications.

19 Claims, 3 Drawing Sheets

130
57
56

40
60
100
132
128
134
136
52
56
120
50
50a
50b
94a
94b
94
94c
32
92
92a
96
98
90

SLIVER PATCHING METHOD AND APPARATUS

BACKGROUND OF THE INVENTION

The present invention relates generally to wood products and particularly to the repair of defects in high-grade wood products.

Small dimension high-grade lumber stock having clear vertical grain is used as finish lumber in furniture, doors, cabinets and the like. Such finish lumber is expensive and must be substantially free of defects. Manufactures, in cutting the high-grade lumber stock to final dimensions, often expose defects previously unseen. A common type of defect exposed during processing is a long slender pitch pocket following the wood grain. The presence of such pitch pockets renders an otherwise high-grade wood product unusable as finish lumber. Unless the defect is cured, the wood product cannot be used for finish applications. To properly cure the defect and render the product usable in a finish application, the repair must be of high quality. If the repair is not of high quality, the wood product is usable only for lower grade applications. Because such wood products are expensive, defects exposed during processing represent a significant loss of investment to the manufacturer.

In any wood processing operation, worker safety is a paramount concern. Repair of the above noted defects in small dimension high-grade wood products must be accomplished with minimal risk of injury to workers. In curing defects in such small dimension lumber, it would be necessary that workers handle each article separately as the defects are non-uniform and require individual treatment. Such individual treatment or handling by workers of small dimension lumber introduces the potential for injury. Thus, any method of curing such defects must account for such risk in order to avoid injury to workers.

OBJECTS AND ADVANTAGEOUS OF THE PRESENT INVENTION

It is, therefore, an object of the present invention to provide a method for repairing defects in high-grade small dimension wood products otherwise discarded upon exposure of defects during processing. By curing such defects, the manufacturer avoids loss of investment in the high-grade wood product.

It is an object of the present invention to cure defects in high-grade lumber in a manner which preserves the high-grade quality of the wood product, in particular, the natural grain pattern of the wood product. By such repair, the wood product remains useful for finish applications without degrading the quality of the final product into which the wood product is incorporated.

It is a further object of the present invention to provide a method and apparatus for curing defects in lumber in a safe manner. The risk of injury to workers is thereby minimized despite the need for individual handling of the wood products during the process of repair.

SUMMARY OF THE INVENTION

The foregoing objects and advantages are achieved by a method for patching a defect in a wood article wherein a groove following the wood grain of the article is cut in the article to remove the defect. An adhesive is placed in the groove and a wood sliver, having a longitudinal grain, is inserted in the groove. The size and shape of a portion of the sliver resting within the groove corresponds to the size and shape of the groove.

The remaining portion of the sliver, that portion outside the groove, is sanded to achieve a smooth finish surface. Because the groove and sliver are narrow and follow the wood grain, the sliver patch is difficult to detect in the final product. The method of the present invention thereby retains the high-grade quality of the wood product. In many cases, the sliver is narrow enough to fit between the grain lines of the wood product and is barely noticeable as it blends in naturally with the overall grain pattern.

In a preferred embodiment of the present invention, an apparatus for applying sliver patches includes a reference line and a cutting element movable in parallel relation to the reference line. An operator aligns the defect with the reference line, but offsets the defect to lie in the path of the cutting element. A clamping device retains a defective wood article relative to the reference line. An operator then clamps the article relative to the reference line and cuts a groove in the article to remove the defect. Glue is applied to the groove and a sliver, corresponding in shape and size to the groove, is inserted within the groove. The article is sanded and a smooth high-grade surface results.

According to one aspect of the present invention, the above described apparatus may be used as an accessory to a commercial sander whereby the above-described patching operation is easily incorporated into sanding operations.

The subject matter of the present invention is particularly pointed out in the concluding portion of this specification. Both the organization and method of operation of the invention, together with further advantages and objects thereof, however, may best be understood by reference to the following description and accompanying drawings wherein like reference characters refer to like elements.

DETAILED DESCRIPTION OF THE INVENTION

Figure 1:
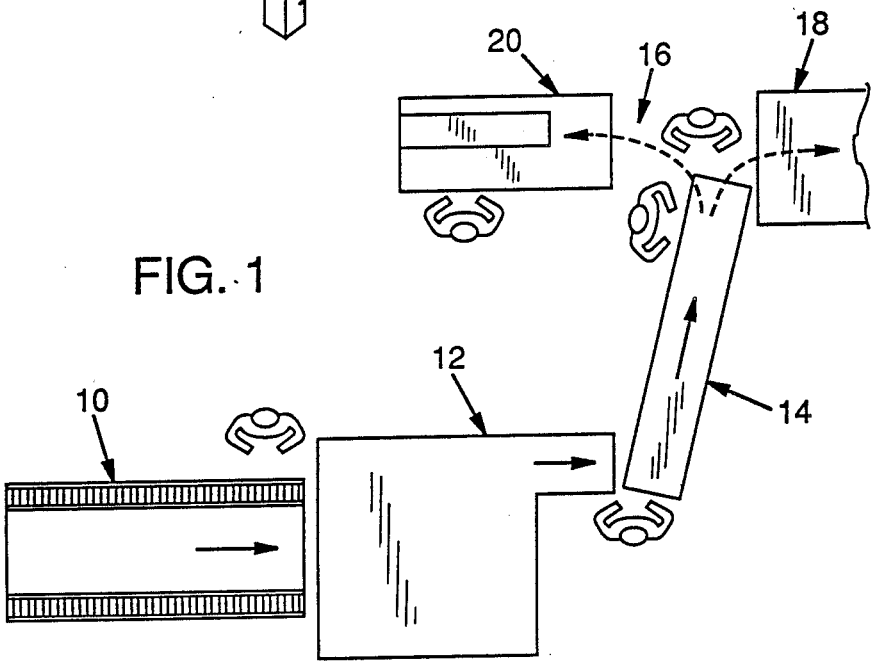
FIG. 1 is plan view of a manufacturing operation for small dimension, high-grade lumber including a patching station operating in accordance with the present invention.

FIG. 1 is a top plan view of a manufacturing operation for processing small dimension, high-grade lumber products. Wood products enter the illustrated portion of the manufacturing plant on a conveyor belt 10 and pass through a resaw station 12. The resaw station 12 cuts the wood products into final dimensions for later incorporation into finished products, such as furniture, doors, cabinets and the like. In cutting the wood products into smaller or finish dimensions, defects in the wood products, previously unseen, are exposed. Because the wood products are to be used in finish lumber applications, such defects are undesirable and in many cases render the wood product unusable for such finish applications. Upon exiting the resaw station 12, the wood products are carried along a conveyor belt 14 to a grading station 16 located at the terminal end of conveyor belt 14 At the grading station 16, workers identify wood products having the aforementioned defects. Wood products not having such defects continue with normal processing along conveyor belt 18 to undergo sanding operations. Defective wood products are diverted from conveyor belt 14 to patching station 20 for repair in accordance with the present invention.

Figure 2:
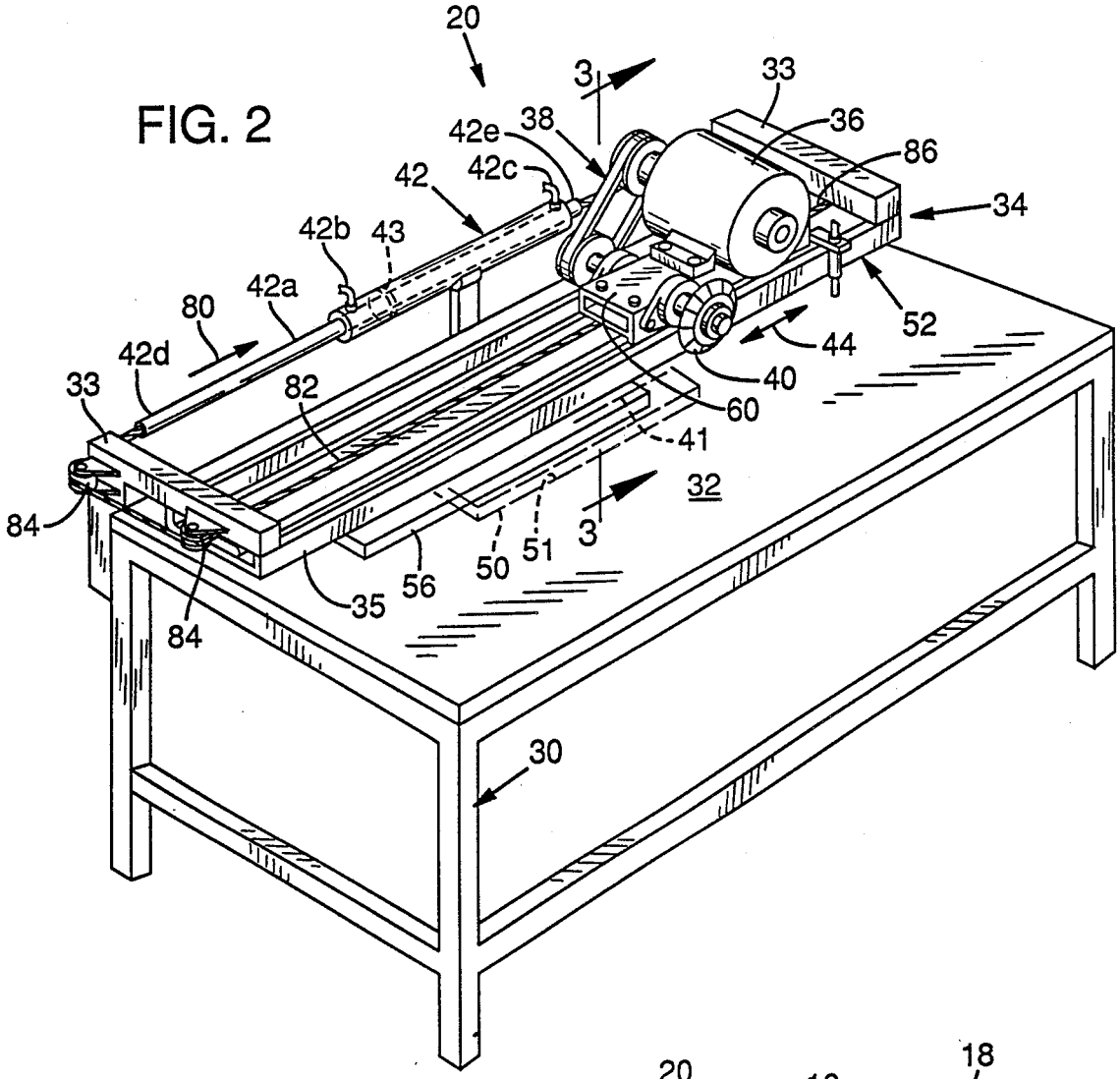
FIG. 2 is a more detailed perspective view of the patching station of FIG. 1.

FIG. 2 illustrates the patching station 20 in greater detail. Patching station 20 includes a table 30 having a work surface 32 and a carriage assembly 34 positioned over the surface 32. The carriage assembly 34 is supported over surface 32 by frame elements 33 interconnecting table 30 and carriage assembly 34. In the carriage assembly 34, a motor 36, drive assembly 38 and cutting element 40 are mounted upon a sliding frame 60 for rearward and forward movement along the carriage assembly 34 as indicated by double-headed arrow 44 of FIG. 2. An air cylinder 42 is mounted to table 30 adjacent carriage assembly 34 and is coupled to frame 60 for actuating sliding movement of frame 60. Air cylinder 42 is a bi-directional device to actuate movement of frame 60 in forward or reverse directions.

Patching station 20 also includes a platen 50 positioned within a recess 51 of the work surface 32. Platen 50 is normally co-planar with the work surface 32, but may be raised vertically toward a stationary undersurface 52 of carriage assembly 34. A workpiece 56, i.e., a high-grade, small dimension lumber product, is captured between platen 50 and undersurface 52 by raising platen 50 toward undersurface 52. The cutting element 40 extends below the undersurface 52. With workpiece 56 so captured between platen 50 and undersurface 52, cutting element 40 engages the workpiece 56 as frame 60 slides along assembly 34. A groove is thereby cut along the length of workpiece 56. Workpiece 56 is freely positionable relative to the path 41 of cutting element 40 prior to activation of platen 50. Workpiece 56 is positioned to align long, slender defects, such as pitch pockets, relative to the path 41 of cutting element 40. Thus, upon engagement of cutting element 40, the defect is removed from workpiece 56 leaving a groove of predetermined size and shape. Upon release, i.e., the lowering of platen 50, the workpiece 56 is removed from work surface 32 for further patching operations.

Figure 3:
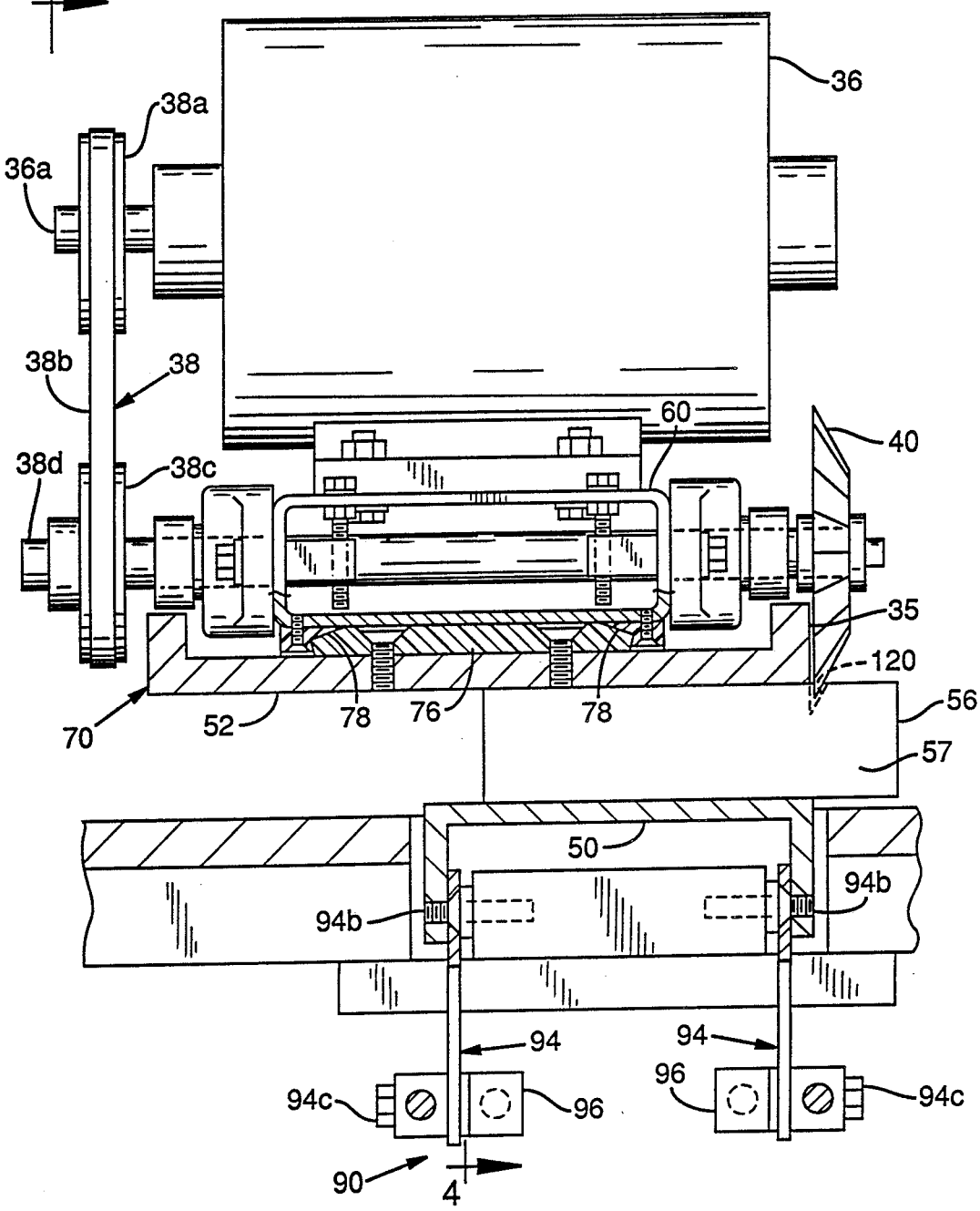
FIG. 3 is a sectional view of a portion of the patching station of FIG. 2 taken along lines 3—3 of FIG. 2.

FIG. 3 better illustrates operation of the motor 36, drive assembly 38 and cutting element 40. The output shaft **36*a* of motor 36 carries a pulley 38*a* of drive assembly 38. Belt 38*b* of drive assembly 38 couples to a second pulley 38*c*. carried by a shaft 38*d* rotatably mounted to frame 60. Rotation of output shaft 36*a* by motor 36 causes rotation of the shaft 38*d*. The cutting element 40 is mounted upon the shaft 38*d* at an opposite end thereof relative to the pulley 38*c*. Thus, upon activation of motor 36, the cutting element 40** rotates.

Carriage assembly 34 includes a stationary base 70. The aforementioned stationary undersurface 52 of carriage assembly 34 is the undersurface of base 70. On the upper surface of base 70, a guide 76 is mounted to and extends along substantially the entire length of base 70. In the preferred embodiment of the present invention, guideways 78 are composed of slippery plastic bearing material such as sold under the trade mark NYLATRON, and the guide 76 is composed of cold rolled steel. The sliding frame 60 includes corresponding guideways 78 on its undersurface which engage the guide 70 for the purpose of achieving the desired sliding movement of frame 60.

With reference to FIG. 2 in conjunction with FIG. 3, the air cylinder 42 includes a piston **42*a*, a forward air inlet 42*b* and a return air inlet 42*c*. The piston 42 extends beyond each end of the cylinder 42 and carries a sealing disk 43 within cylinder 42. Introduction of compressed air into inlet 42*b*, with inlet 42*c* open, causes piston 42*a* to thrust in a forward actuation direction as indicated by the arrow 80 in FIG. 2. Similarly, introduction of compressed air into inlet 42*c*, with inlet 42*b* open, causes the piston 42*a* to thrust in a return actuation direction, opposite that indicated by the arrow 80. As shown in FIG. 2, the piston is in its return position ready for movement in the forward actuation direction. A forward end 42*d* of the piston 42*a* is coupled by way of a cable 82 to the sliding frame 60. The cable 82 wraps around a forward end of base 70 through a pair of pulleys 84 mounted to one of frame elements 33. A rear end 42*e* of the piston 42*a* is similarly coupled, by way of a cable 86 and pulleys (not shown) at the rearward end of base 70, to the sliding frame 60. Thus, it may be appreciated that selected introduction of compressed air into the inlets 42*b* and 42*c* moves the cutting element 40 in forward and rearward directions along its path 41**.

Figures 4, 9:
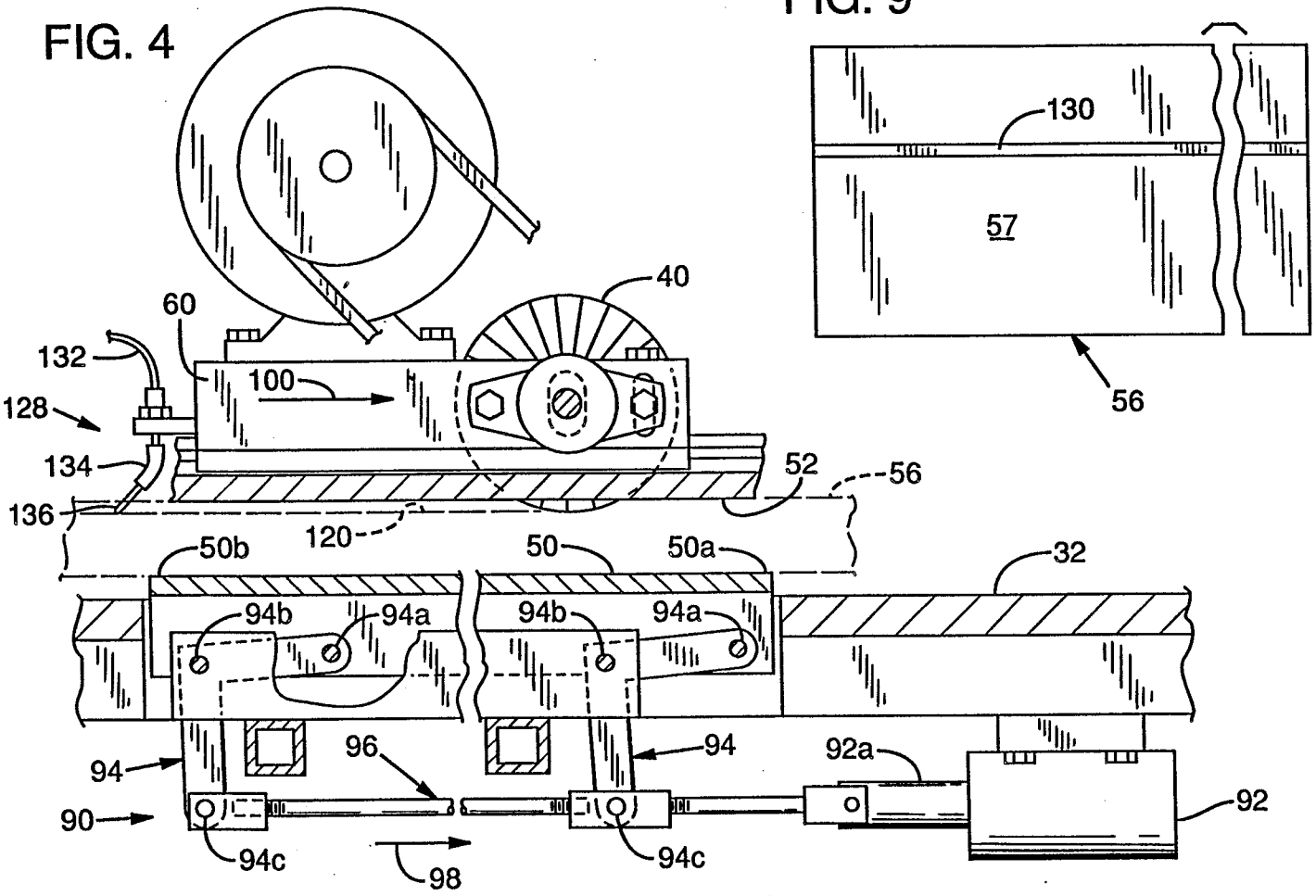
FIG. 4 is a sectional view of the patching table of FIG. 3 taken along lines 4—4 of FIG. 3.
FIG. 9 is a top plan view partially broken away of a workpiece including a sliver patch in accordance with the present invention.

With reference to FIGS. 3 and 4, platen 50 is actuated by means of a linkage assembly 90 and an air cylinder 92, each positioned at the underside of table 30. Platen 50 is supported by four angle brackets 94, two at a forward end **50*a* of platen 50 and two at a rearward end 50*b* of platen 50. Each angle bracket includes three pivot points. A first pivot point 94*a* located at the end of a horizontal leg of each angle bracket 94 pivotally couples each bracket 94 to the platen 50. A second pivot point 94*b* located at the corner of each angle bracket 94 pivotally couples each bracket 94 to the table 30. A third pivot point 94*c* located at the end of a vertical leg of each bracket 94 pivotly couples to a horizontal linkage 96. Movement of all angle brackets 94 is thereby unified. Horizontal movement of linkage 96 in a forward direction, as indicated by the arrow 98 of FIG. 4, causes each angle bracket 94 to pivot about the pivot point 94*b* and raise the pivot point 94*a*. In raising the pivot points 94*a*, the platen 50 raises toward the undersurface 52 of carriage assembly 34. Movement of linkage 96 in a rearward direction, opposite that indicated by arrow 98, lowers each pivot point 94*a* and therefore the platen 50. The linkage 96 couples to a piston 92*a* of the air cylinder 92. Actuation cylinder 92 causes the aforementioned horizontal forward or rearward movement of the linkage 96 in order to raise or lower, respectively, platen 50. Thus, it may be appreciated that selected actuation of the air cylinder 92 accomplishes the desired clamping action of workpiece 56 between platen 50 and undersurface 52**.

As shown in FIG. 4, the sliding frame 60 is moving in a forward direction, indicated by arrow 100, and the cutting element 40 is engaging the workpiece 56 to cut a groove 120 therein. Mounted to a rear portion of the sliding frame 60 is a glue dispensing device 128. Device 128 includes a glue source (not shown) which delivers glue by way of an inlet tube 132 to a dispensing valve 134 of device 128. The outlet of valve 134 comprises a tube 136 extending slightly below undersurface 52. Tube 136 is aligned with the path 41 of cutting element 40. Thus, as the cutting element 40 travels in a forward direction, cutting the groove 120 in the workpiece 56, the outlet tube 136 of valve 134 lies within the freshly cut groove 120.

The tube 136 normally extends slightly farther below the undersurface 52 than cutting element 40. Upon engagement with the groove 120, the tube 136 bears against the bottom of groove 120 and the dispensing valve 134 bends as shown in FIG. 4. The dispensing valve 134 is of a conventional type which opens upon such bending action to permit passage of glue from inlet tube 132 to outlet tube 136. Glue is thereby automatically dispensed into the groove 120. When tube 136 clears the end of workpiece 56, it straightens and closes the valve 134. Thus, it may be appreciated that the glue dispensing device 128 automatically applies a layer of glue to the groove 120 as the cutting clement 40 cuts the groove 120 in the workpiece 56.

Once the groove 120 is cut in the workpiece 56, and glue applied to the groove 120, a wood sliver is inserted within the groove 120. As seen in FIG. 3, the groove 120 is a substantially V-shaped groove corresponding in shape to the cutting element 40. Although a V-shape is advantageous since the sliver wedges into place, it should be understood that the groove 120 may be of any other predetermined, cross-sectional shape for which a corresponding wood sliver can be manufactured.

Figure 5:
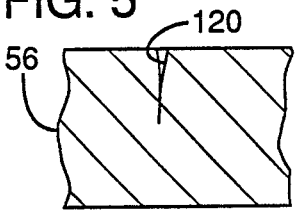
FIG. 5 is a sectional view of a wood product undergoing repair in accordance with the present invention.
Figure 6:
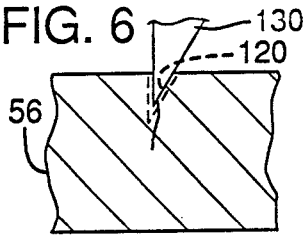
FIGS. 6–7 are sectional views which illustrate insertion of a sliver patch in the wood product of FIG. 5 in accordance with the present invention.
Figure 7:
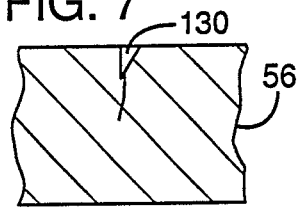

FIGS. 5–7 illustrate insertion of wood sliver 130 within groove 120. In FIG. 5, the workpiece 56 is shown in cross-section illustrating the V-shape of the groove 120. In FIG. 6, the wood sliver 130, inserted within the groove 120 with a lower portion, closely held within groove 120, corresponds in size and shape to the groove 120. An upper portion of the sliver 130 lies outside the groove 120. That portion of the sliver 130 lying outside the groove 120 is removed by conventional sanding operations. FIG. 7 shows the sliver 130 following sanding operations. The finish surface of workpiece 56 may be sanded smooth whereby the top of sliver 130 is co-planar to the finish surface of workpiece 56. Because the sliver 130 is narrow, lying along the grain of the workpiece 56, the sliver 130 hides within the grain of the workpiece 56. The high-grade quality of workpiece 56 is thereby retained.

FIG. 9 is a top plan view of the workpiece 56. With reference to FIG. 3 in conjunction with FIG. 9, it may be seen that the grain lines 57 of workpiece 56 are substantially parallel to the narrow sliver 130. Also, the sliver extends the entire length of the work piece 56. The sliver 130 thereby blends with the natural grain pattern of workpiece 56.

Figure 8:
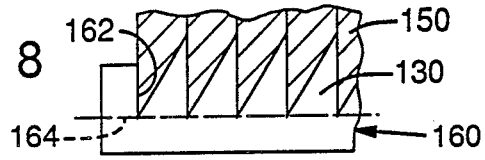
FIG. 8 is a sectional view which illustrates manufacture of sliver patches similar to that shown in FIGS. 6 and 7.

FIG. 8 illustrates manufacture of the wood slivers 130. In FIG. 8, a set of cutting elements 150 are arranged concentrically in stacked relation. The arrangement of cutting elements 150 are applied to a wood workpiece 160 in order to cut a series of contiguous parallel grooves 162 therein. Each of grooves 162 is thereby a substantially V-shaped groove, and by virtue of the contiguous positioning of grooves 162, the portions of workpiece 160 intermediate of grooves 160 comprise V-shaped elements 130. By then cutting the workpiece 60 along the base of the grooves 162, as indicated by the dotted line 164, the elements 130 are cut away from the workpiece 160 and desirably form the V-shaped wood sliver previously described in connection with FIGS. 5–7.

In overall operation, an operator of sliver patching station 20 first orients the workpiece 56 along a reference edge 35 (FIGS. 2 and 3) of the base 70 adjacent the path 41. By orienting the defected portion of the workpiece 56 adjacent the reference edge 35, the operator desirably aligns path 41 of cutting element 40 with the defective portion of the workpiece 56. Upon activation of the air cylinder 42, i.e., by introduction of compressed air into inlet 42*b*, cutting element 40 travels in a forward direction toward the workpiece 56 and cuts the groove 120 therein to remove the defective portion of workpiece 56. Concurrent with the cutting of the groove 120, the glue dispensing device 130 (FIG. 4) applies glue to the groove 120. The platen 50 by operation of the air cylinder 92 to lower the platen 50 away from the undersurface 52 of carriage assembly 34 and releases the workpiece 56. The air cylinder 42 is actuated, by introduction of compressed air into inlet 42*c* to return the cutting element to the rear portion of assembly 34, placing it in position for the next cut.

The worker then places the wood sliver 130 within the groove 120 and delivers the workpiece 56 to the sanding stage of the manufacturing process by way of conveyor belt 18 In the sanding process, the upper portion of the sliver 130, that lying outside the groove 120, is removed by conventional sanding operations leaving a finished surface of high-grade quality.

As a safety measure, the air cylinders 42 and 92 may be actuated by a pair of spaced hand operated switches (not shown). An operator of patching station 20, after positioning the defect relative to the reference line 35, would use both hands to activate the spaced switches concurrently to initiate the aforementioned clamping action by platen 50 and sliding action of cutting element 40. Thus, it may be appreciated that the patching station 20 is adaptable to accommodate worker safety precautions despite the fact that the operator must individually hand place each workpiece processed. The entire process could be automated whereby the operator initiates the cutting and clamping action, and a pressure actuated switch arm mounted to sliding frame 60 slides upon the upper surface of the workpiece 56. When the switch arm drops off the edge of the workpiece, the cutting element is deactivated, the platen 50 drops, and cutting element returns to its initial position.

While a preferred embodiment and several alternative embodiments of the present invention have been shown and described, it will be apparent to those skilled in the art that many changes and modifications may be made without departing from the invention in its broader aspects. For example, in a preferred embodiment of the present invention, the width of groove 120 at the surface of workpiece 56 is approximately 3/16ths of an inch. However, it will be understood that other dimensions for groove 120 may be used where suitable in light of the width between grain lines in the workpiece and/or the width of defects found in the workpiece. The appended claims are, therefore, intended to cover all such changes and modifications as fall within the true spirit and scope of the invention.

I claim:

1. A method for patching a defect in a wood workpiece, the defect being along a longitudinal grain pattern in said workpiece, the method comprising:

cutting a groove in the workpiece substantially parallel to the grain pattern to substantially remove the defect from the workpiece;

applying adhesive to said groove;

inserting a wood sliver partially in said groove, the sliver having a longitudinal grain pattern, a first portion of said sliver corresponding in shape and size to the groove and a second portion of said sliver being outside said groove; and removing the second portion of said sliver.

2. The method according to claim 1 wherein said groove is cut to a predetermined size and shape.

3. The method according to claim 2 wherein said groove is cut to a substantially V shaped cross section.

4. The method according to claim 1 wherein said step of cutting a groove includes cutting said groove along the entire length of said workpiece.

5. The method according to claim 1 wherein said step of removing the second portion of said sliver is accomplished by sanding.

6. The method according to claim 1 wherein said groove is cut to a substantially V shaped cross section with the upper width of the groove cross section being less than one quarter inch.

7. A method for patching a defect in a wood workpiece, the defect being along a longitudinal grain pattern in said workpiece, the method comprising:

aligning said defect relative to a reference line;

clamping said workpiece in position relative to said reference line;

cutting a groove in said workpiece relative to said reference line and substantially parallel to the grain pattern to remove the defect;

applying adhesive to said groove;

inserting a wood sliver partially in said groove, the sliver having a longitudinal grain pattern, a first portion of said sliver corresponding in shape and size to the groove and a second portion of said sliver being outside said groove; and removing the second portion of said sliver.

8. The method according to claim 7 wherein said groove is cut to a width of substantially the same width as grain lines in said workpiece.

9. The method according to claim 7 wherein said groove is cut to a predetermined size and shape.

10. The method according to claim 9 wherein said groove is cut to a substantially V shaped cross section.

11. The method according to claim 7 wherein said step of cutting a groove includes cutting said groove along the entire length of said workpiece.

12. The method according to claim 7 wherein said step of removing the second portion of said sliver is accomplished by sanding.

13. The method according to claim 7 wherein said groove is cut to a substantially V shaped cross section with the upper width of the groove cross section being less than one quarter inch.

14. In a lumber processing operation, a method of detecting and repairing defects, the method comprising:

applying a small dimension high-grade workpiece to a cutting operation exposing an interior portion of said workpiece as a newly cut face portion, said newly cut face portion having a longitudinal grain pattern;

inspecting said newly cut face portion for defects and diverting said workpiece to a patching station upon detecting defects therein;

aligning, at said patching station, said defect relative to a reference line of said patching station;

clamping said workpiece relative to said reference line;

cutting a groove in said workpiece relative to said reference line and substantially parallel to the longitudinal grain pattern of said newly cut face portion to substantially remove said defect from said workpiece;

applying adhesive to said groove;

inserting a wood sliver partially in said groove, the sliver having a longitudinal grain pattern, a first portion of said sliver corresponding in size and shape to said groove and disposed within said groove, a second portion of said sliver being outside said groove; and removing the second portion of said sliver.

15. The method according to claim 14 wherein said second portion of said sliver is removed by sanding.

16. The method according to claim 14 wherein said groove is cut along the length of said workpiece and partially through the depth of the workpiece.

17. An apparatus for repair of defects in small dimension high-grade lumber, the apparatus comprising:

a work surface;

a carriage assembly disposed above said work surface, said carriage assembly including an undersurface stationary and in face-to-face relation relative to said work surface, said carriage assembly including a cutting element positioned partially below said under surface and means for sliding movement of said cutting element in parallel relation to a reference line of said carriage assembly;

a platen disposed within a recess of said work surface and having an upper surface normally positioned co-planar with said work surface, said upper surface of said platen being in face-to-face relation to said undersurface of said carriage assembly;

releasable clamp activation means for moving said platen toward or away from said under surface of said carriage assembly whereby small dimension wood products may be selectively clamped therebetween; and means for selectively moving said cutting element in substantially parallel movement relative to said reference line whereby said cutting element will engage a wood product clamped between said under surface of said carriage assembly and said platen to cut a groove therein.

18. The apparatus according to claim 17 further comprising adhesive dispensing means slidably mounted to said carriage assembly and in alignment with the path of the cutting element whereby upon cutting the groove in the wood product, said glue dispensing means applies glue to the groove.

19. A method for patching a defect in a wood workpiece, the defect being along a longitudinal grain pattern in said workpiece, the method comprising:

cutting a groove in the wood workpiece, the groove being cut at a location selected so as to substantially remove the defect from the workpiece, the groove extending the entire distance between two edges of the workpiece and being substantially parallel to the grain pattern of the workpiece being cut;

adhesively securing a wood silver in said groove.

* * * * *